US006871521B2

(12) United States Patent
Sperrer

(10) Patent No.: US 6,871,521 B2
(45) Date of Patent: Mar. 29, 2005

(54) METHOD FOR OPERATING A BENDING PRESS AND BENDING PRESS, ESPECIALLY A FOLDING BENDING PRESS

(75) Inventor: Gerhard Sperrer, Wartberg/Krems (AT)

(73) Assignee: Trumpf Maschinen Austria GmbH & Co. KG, Pasching (AU)

( * ) Notice: Subject to any disclaimer, the term of this patent is extended or adjusted under 35 U.S.C. 154(b) by 66 days.

(21) Appl. No.: 10/364,890

(22) Filed: Feb. 12, 2003

(65) Prior Publication Data

US 2003/0221467 A1 Dec. 4, 2003

Related U.S. Application Data

(63) Continuation of application No. PCT/AT01/00255, filed on Jul. 25, 2001.

(30) Foreign Application Priority Data

Aug. 16, 2000 (AT) ..... A 1406/2000

(51) Int. Cl.[7] ..... G06F 15/46; B21D 5/02; B30B 15/18

(52) U.S. Cl. ..... 72/21.1; 72/8.1; 72/389.5; 72/389.6; 72/702; 364/416; 364/474.07; 700/165

(58) Field of Search ..... 72/8.1, 19.8, 21.1, 72/20.1, 389.4, 389.5, 389.6, 702; 364/474.07, 476, 475, 472; 700/165

(56) References Cited

U.S. PATENT DOCUMENTS 4,819,467 A * 4/1989 Graf et al. ..... 72/8
5,193,452 A * 3/1993 Dieperink ..... 72/389.6
5,272,643 A * 12/1993 Tokai ..... 72/380
5,329,795 A * 7/1994 Sartorio et al. ..... 72/21
6,581,427 B2 * 6/2003 Gerritsen ..... 72/31.11
6,708,541 B1 * 3/2004 Matsumoto et al. ..... 72/31.1

FOREIGN PATENT DOCUMENTS

| | | |
|---|---|---|
| DE | 39 21 034 A1 | 7/1988 |
| DE | 693 09 610 T2 | 5/1997 |
| EP | 0 540 476 A1 | 10/1991 |
| EP | 0 596 697 A1 | 5/1994 |
| JP | 06328137 A | 11/1994 |

* cited by examiner

*Primary Examiner*—David Jones
(74) *Attorney, Agent, or Firm*—Alston & Bird LLP

(57) ABSTRACT

A method of operating a bending press, in particular an edging press, and a bending press for carrying out this method. For each drive of a drive arrangement, the actual pressing force is detected for the displaceable press beam during a bending process for the workpiece and a relative position of the pressing tool or tools by reference to the longitudinal extension of the press beams is determined on the basis of a force ratio. Different displacement paths of the drives and the displaceable press beam at the respective force-application point of the drive are then determined in an evaluation and/or computer unit, which is provided with a data memory for production and machine data, and corresponding control signals for the drive system are generated in the control unit and actuator elements of the drives are displaced by the displacement paths determined for each drive.

19 Claims, 3 Drawing Sheets

METHOD FOR OPERATING A BENDING PRESS AND BENDING PRESS, ESPECIALLY A FOLDING BENDING PRESS

CROSS-REFERENCE TO RELATED APPLICATIONS

This application is a continuation of International Patent Application PCT/AT01/00255 filed Jul. 25, 2001, which designated inter alia the United States.

FIELD OF THE INVENTION

The invention relates to a method of operating a bending press having a machine frame comprising two stand sides spaced at a distance apart from one another, and a stationary press beam and a displaceable press beam displaceable in guide arrangements and driven by a drive system incorporating at least two drives, and having tool clamping devices for holding pressing tools on mutually facing compression surfaces of the press beams. The invention also relates to such a bending press.

BACKGROUND OF THE INVENTION

A method and a device for measuring and adjusting compression forces on a press are known from patent specification DE 693 09 610 T2. With this method and device, values of compression force are measured and adjusted in order to obtain a predefined local load distribution as a means of setting the desired localised load distribution irrespective of the specific characteristic data of the press.

In order to produce an exact bending angle on a workpiece finished on a bending press, in particular an edging press, it is also standard practice in the field to use a measuring process to measure the workpiece after bending, in particular the bend angle, and, depending on the thrust depth of the pressing tools detected by a displacement measuring system, to make the requisite correction to the bend angle by changing the thrust depth to obtain the predetermined bend angle during subsequent forming processes. With this type of approach, in which the displacement measuring system is disposed on a separate auxiliary frame in order to take account of force-dependent flexing of the C-shaped side-stands of the machine, production errors occur due to the bending behavior of the press beam, which is also dependent on force as well as the position of the working region on the press beams.

A device for preventing inaccuracies caused by the bending behavior of the press beams during production is also known from patent specification DE 39 21 034 A1, by means of which the bending lines which occur at the co-operating press beams extend substantially parallel and concentric with one another at the instant of the maximum thrust depth of the tools needed to produce the bending angle of the workpiece. However, this approach does not allow a non-symmetrical bending line caused by an eccentric load to be taken into account, which can lead to production failures due to rejects and also rules out the use of many of the advantageous manufacturing options offered by pressing tools used in off-center applications.

SUMMARY OF THE INVENTION

The objective of the method proposed by the invention is to control the displacement paths of a drive system having at least two drives depending on deformations of both the machine frame and the cooperating press beams caused by compression forces.

This objective is achieved in accordance with the invention, wherein a method for operating the press comprises steps of:

detecting an actual pressing force exerted by each drive of the drive system on the displaceable press beam during a bending process for the workpiece;

determining a relative position of the pressing tool or tools with respect to a longitudinal direction of the press beams on the basis of the pressing forces of the drives;

using an evaluation and/or computer unit having a data memory for production and machine data to determine a displacement path for each of the drives at the respective force-application point of each drive; and generating control signals for the drive system in the control unit, so as to displace actuator elements of the drives by the displacement paths determined for each drive.

The surprising advantage of this approach is that irrespective of the relative position of the working and shaping region with respect to the longitudinal extension of the press beams and the resultant uneven distribution of compression forces on the drives, which also causes asymmetrical bending lines of the press beams as well as differing flexing behavior of the mutually spaced side stands with the drives, these factors affecting the production quality can be compensated by regulating the displacement path for each of the drives depending on this load-specific deformation behavior, and the thrust depth of the pressing tools which is so crucial to the quality of the shaping process can be made uniform across the entire shaping region.

An embodiment wherein deformation data of the bending press are stored in the data memory, and the displacement paths of each drive and actuator element are determined based on the deformation data stored in the data memory, is of advantage because it enables displacement paths of the drives to be rapidly adapted in order to correct an angular position of the bending tools relative to one another.

Another embodiment, wherein load-dependent deformations of the bending press are computed from the pressing forces of the drives on the basis of algorithms stored in the evaluation and/or computer unit, and the displacement paths of the drives and the actuator elements are determined so as to take into account the load-dependent deformations, is of advantage because the effective load states are processed in a computation based on actual figures to generate measures for adjusting the drives, so that inaccuracies graded in a matrix can be eliminated.

In another embodiment, the displacement path of each drive is determined in the evaluation and/or computer unit on the basis of one or more of material data for the workpiece to be shaped, an effective tool length of the pressing tools, and a bending angle, which are stored in the data memory. In this manner, material-specific data is available and therefore enables the production parameters to be rapidly adjusted to suit the materials currently being processed.

In yet another embodiment, the displacement path of each drive is determined in the evaluation and/or computer unit on the basis of machine data of the bending press stored in the data memory, the machine data comprising load-dependent flexing behavior of the stand sides of the bending press and/or of the press beams. Thus, machine-specific data is directly applied for determining the displacement paths of the drives, thereby compensating for any deformation in the machine.

In a further embodiment, the displacement path of each drive is determined in the evaluation and/or computer unit on the basis of algorithms stored in the data memory for the force-dependent flexing behavior of the stand sides and/or the press beams. Accordingly, the displacement paths can be determined by computing instantaneous values, thereby avoiding the time-consuming process of searching through numerous data files as would normally be necessary, and the results therefore correspond to actual prevailing loads and associated deformations of the machine stand and press beams, in other words the effects of force on the bending press.

In accordance with another embodiment of the invention, the allocation of forces to the drives can be determined depending on the results of deformation measurements on essential machine components, such as the stand sides, and hence the resultant and anticipated deformations, and the requisite control functions, such as determining the different displacement paths of each drive, can be generated using stored machine data or by computational methods using pre-set algorithms.

In a further embodiment, the detected actual pressing forces are compared in a control circuit of the evaluation and/or computer unit with desired pressing forces stored in the data memory, or actual displacement paths detected by a displacement-measuring system are compared in a control circuit of the evaluation and/or computer unit with desired displacement paths stored in the data memory, and control signals for the drive system are forwarded to the control unit accordingly. In this manner, a permanent monitoring system can be operated with counter-control of the entire production process on the basis of an actual/desired comparison of the key factors affecting production quality.

The objective is also achieved by the invention as a result of a bending press in which machine deformations caused by the force applied during a shaping process are compensated by appropriate counter-measures in order to improve production quality. To this end, the press includes a measuring device for detecting machine data, wherein the control unit is an evaluation and/or computer unit provided with a data memory and has a displacement control and regulating device for the drives and detection means for the machine data provided in the form of sensors for measuring at least one of force, pressure, energy, and strain. The surprising advantage of this approach is that, irrespective of the position of the shaping tools and the resultant different load distribution of the machine frame, displacement paths of the drives are handled independently of one another and as a result variances in the position of the cooperating pressing tools resulting from a machine deformation during the working stroke of the displaceable press beam are compensated.

The detection means can be disposed in a supply circuit for the drives and/or in the control unit and/or in the drives, and can comprise strain gauges or pressure sensors disposed on the stand sides, or strain gauges disposed on the press beams. This is of advantage because variables are determined for all influencing factors and are then available as measurement data for setting the optimum displacement of the displaceable press beam.

Other possible embodiments provide that the actual values of the displacement paths are compared with desired values in the initial settings and correction measures set, which are then available during subsequent work operations in order to optimise the production process.

Another embodiment is also of advantage because it enables an exact adjustment of the relative position of the pressing tools.

Finally, providing the displacement control and regulating device as a freely programmable controller or a computer simplifies the task of setting up the program so that different program sequences are adapted to production sequences.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
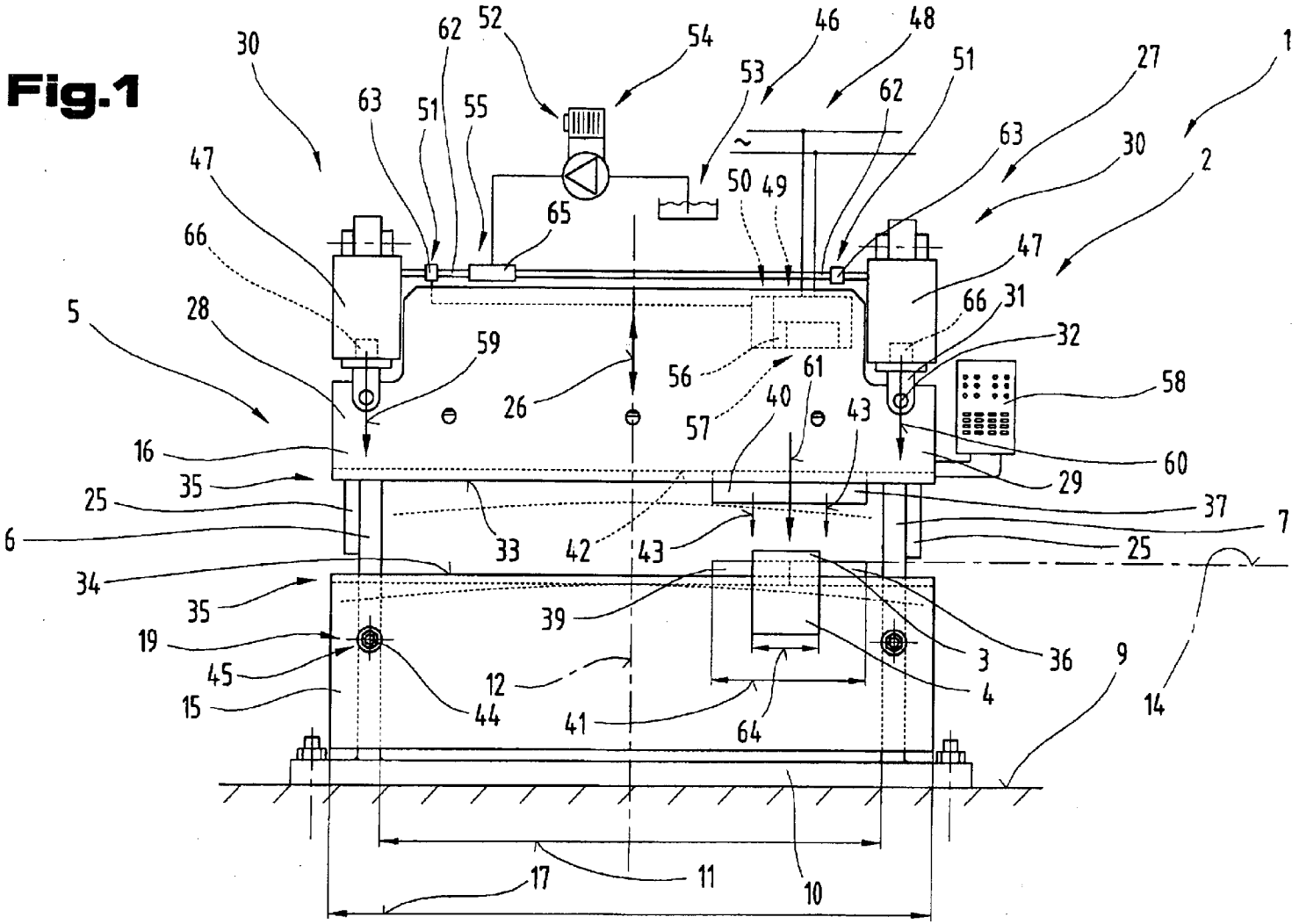
FIG. 1 shows a front view of the bending press proposed by the invention.
Figure 2:
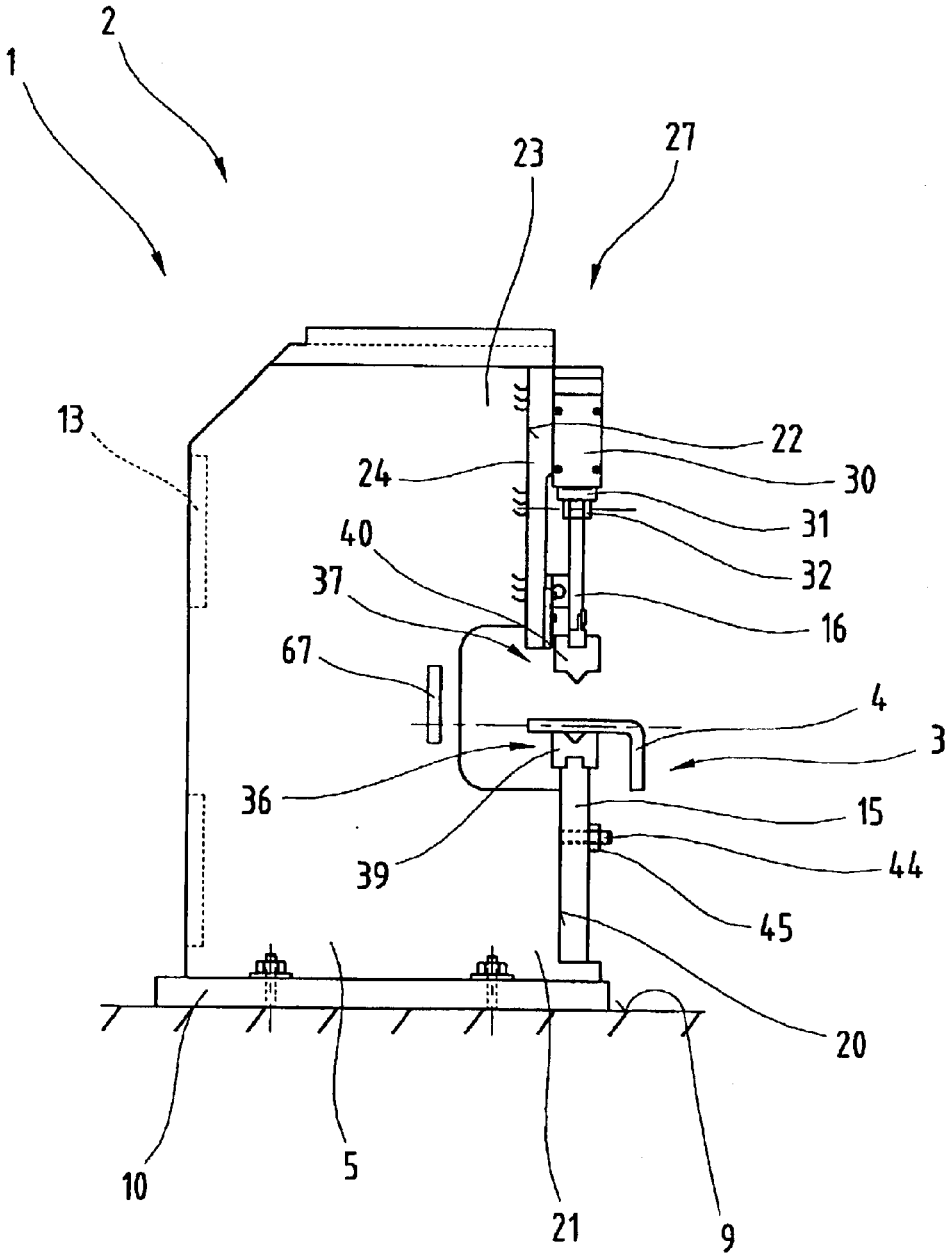
FIG. 2 shows a side view of the bending press.

FIGS. 1 and 2 illustrate a production unit 1, in particular an edging press 2, for shaping sheet metal parts 3, in particular, to produce housing parts 4, sections, etc. In order to achieve the highest possible quality, it is necessary to take account of a whole series of factors intrinsic to the production unit 1. One factor that is decisive in terms of the shaping quality is that of obtaining a thrust depth of the cooperating tools which extends uniformly across the entire shaping length or tool length and this is influenced by force-dependent deformations in the production unit 1, such as flexing or bending deformation in key areas of the edging press 2.

A machine frame 5 of the production unit 1 includes two C-shaped stand sides 6, 7 spaced at a distance apart from one another, which are supported by means of damping elements in order to damp vibrations under specific installation conditions or may be predominantly supported directly on a standing surface 9 and, where possible, secured, in particular welded, to a common base plate 10. The stand sides 6, 7 are also joined to one another across a distance 11 by wall parts 13 extending perpendicular to a mid-plane 12.

Relative to a working plane 14 extending parallel with the standing surface 9, the production unit 1 has two oppositely lying press beams 15, 16 extending across a length 17, which is generally determined by the size of the machine and the specified working length along which the sheet metal parts 3 are to be bent, for example to produce housing parts 4.

The press beam 15 directed towards the standing surface 9 is secured to the machine frame 5 by means of a support and/or fixing system 19, preferably directly on end faces 20 of legs 21 of the C-shaped stand sides 6, 7 cooperating with the plate 10 by means of screw bolts or welding. Disposed on end faces 22 of the legs 23, spaced at a distance apart from the standing surface 9, are guard plates 24, optionally extending in a plane perpendicular to the standing surface 9, which are joined to the stand sides 6, 7, preferably by weld seams. These guard plates 24 and the stand sides 6, 7 are provided with guide arrangements 25, by means of which the other press beam 16, lying opposite the press beam 15 by reference to the working plane 14, is mounted so that it can be displaced—in the direction of double arrow 26—by means of a drive system 27. In the embodiment illustrated as an example here, the drive system 27 consists of two double-acting cylinders at the respective end regions 28, 29 of the press beam 16, acting as drives 30 which can be pressurized with a hydraulic medium for example, in particular a hydraulic oil, which are fixed to the guard plates 24, and actuator elements 31, e.g., piston rods, linked in displacement to the press beam 16 in a drive connection, in particular via articulated bearings 32. However, the invention is not restricted to this drive system 27 with drives 30 in the form of cylinders described in detail here. Naturally, instead of the two drives 30 illustrated, it would also be possible to use several such drives 30 as a means of displacing the press beam 16, as well as drives 30 in the form of other types of linear transmissions, e.g., by means of electrically or hydraulically driven screw systems as well as eccentric drives.

Mutually facing end faces 33, 34 of the press beams 15, 16 extending parallel with the working plane 14 have tool holders 35 for supporting and releasably attaching bending tools 36, 37. These bending tools 36, 37 generally form a bending die 39 and a bending punch 40. The bending tools 36, 37 are divided into sections, making it easier to adjust a tool length 41 so that it can be adapted to the prevailing requirements and allow the production unit 1 to be re-fitted or bending tools 36, 37 changed.

The tool holders 35 in the press beams 15, 16 are on the one hand designed to releasably secure the bending tools 36, 37 and on the other hand constitute support surfaces 42 for transmitting bending forces—as indicated by arrow 43.

The press beam 15 disposed underneath the working plane 14 is secured directly to the end faces 20 of the legs 21 assigned to the base plate 10, so that the press beam 15 is symmetrically anchored on the machine frame 5 relative to the mid-plane 12, resulting in a structurally simple mounting which saves on material. In this embodiment of a releasable mounting of the stationary press beam 15, which is described by way of illustration only, the support and/or fixing system 19 is provided in the form of solid bolts 44 welded to the stand sides 6, 7 for example, onto which the press beam 15 is pushed by means of bores provided therein and screwed tight by threaded nuts 45, for example. However, it would also be possible to use a welded joint as the support and/or fixing system 19, in which case the press beam 15 will be non-releasably connected to the stand sides 6, 7.

As mentioned above, the drive system in the embodiment described as an example here is a hydraulic power supply system 46 and the drives 30 are provided in the form of double-acting hydraulic cylinders 47. The production unit 1 also has a control unit 49 wired to a power source 48, e.g. a power mains, and a measuring device 50 wired to the latter, to which external detection means 51, are connected, for example force, pressure, power, strain sensors, etc. As illustrated, the production unit 1 has a hydraulic unit 52 to provide a supply of hydraulic medium, which consists of a tank 53 for the hydraulic medium, a hydraulic pump 54 and the requisite control and switching systems 55. The control unit 49 also has an evaluation and/or computer unit 57 with a data memory 56. Naturally, the control unit 49 is also wired to a control terminal 58, preferably external, equipped with an input and/or indicator and/or monitoring means.

The method proposed by the invention as a means of operating the production unit 1, in particular the edging press 2, will be described in more detail below on the basis of a preferred method with reference to the production unit 1 illustrated in FIGS. 1 and 2 as an example of the invention.

In order to optimize a production process for shaping the sheet metal part 3 to produce a housing part 4, it is often of practical advantage to arrange the bending tools 36, 37 off-center, in other words offset to the side of the mid-plane 12, provided the tool length 41 is shorter than the length 17 of the press beams 15, 16. In many cases, this will facilitate operation and thus permit more rapid handling during production.

This being the case, eccentric loads will occur in the production unit 1 when bending the sheet metal part 3, caused by compression forces of differing magnitudes—indicated by arrows 59, 60. The compression forces—indicated by arrows 59, 60—are computed in accordance with the forces-moment computation on the basis of a bending force—indicated by arrow 61—needed to bend the sheet metal part 3 and the ratio of the distances of the lines along which the compression forces act to the line along which the bending force acts.

The bending force—indicated by arrow 61—which needs to be expended in order to bend the sheet metal part 3 can be determined empirically or by computation and hence pre-set, or alternatively, as is the case with the design of production unit 1 proposed by the invention, determined during the bending process by the detection means 51 in the power supply system 46, and in the particular embodiment described here, the detection means 51 are provided in the form of pressure sensors 63 disposed in delivery lines 62 for the hydraulic medium to the hydraulic cylinders 47. Consequently, the actual compression forces—indicated by arrows 59, 60—can be determined directly as the bending process takes place and digitised in the evaluation and/or computer unit 57 so that the load-dependent effects on the machine frame 5, in particular flexing of the stand sides 6, 7 and deformation of the press beams 15, 16 can be correlated in a load-deformation matrix stored in the data memory 56.

This load-deformation matrix may be set up as a machine-dependent data file for the respective type of production unit 1, either by computation or on an empirical basis, and will contain the relevant deformation values and directly correlated correction factors for the displacement paths of the drives in order to provide compensation and ensure that the bending tools are aligned in a parallel position. These correction factors are obtained on the basis of load-dependent deformations and essentially take account of the respective relative position of the bending tools 36, 37 by reference to the longitudinal extension of the press beams 15, 16 determined from the ratio of compression forces—indicated by arrows 59, 60—and an active tool length or known bending length 64 for bending the sheet metal part 3. These correction factors generate control signals for a displacement control and regulating device 65 contained in the control and switching system 55, e.g. a proportional displacement control, which assigns to each of the drives 30 the requisite displacement path needed to compensate for the deformations and obtain a uniform thrust depth of the bending tools 36, 37 across the entire bending length 64.

In another variant of the method proposed by the invention, instead of storing a load-deformation matrix in the data memory, the force-dependent deformations, such as flexing of the stand sides 6, 7 and bending of the press beams 15, 16 for the respective compression forces which occur—indicated by arrows 59, 60—and the position of the bending tools, can be determined by computation on the basis of algorithms stored in the evaluation and/or computer unit 57 and the displacement path for each drive 30 needed to compensate for the load-dependent deformations determined, after which the displacement control and regulating device 65 controls the displacement of the drives 30.

Naturally, it would also be possible to equip the production unit 1 with a displacement measuring system 66, for which purpose various options known from the prior art may be used, e.g. electro-optical displacement measuring systems, laser-operated displacement-measuring systems, etc., in order to compare the pre-set or determined displacement paths and optionally permit subsequent control measures to be effected in a control circuit. The important aspect of displacement-measuring systems 66 of this type is that they rule out measurement errors caused by deformation, i.e. a displacement-measuring system 66 of this type detects real values.

Another embodiment with additional options for detecting compression forces—indicated by arrows 59, 60—involves disposing strain gauges 67 on the stand sides 6, 7, for example.

Figure 3:
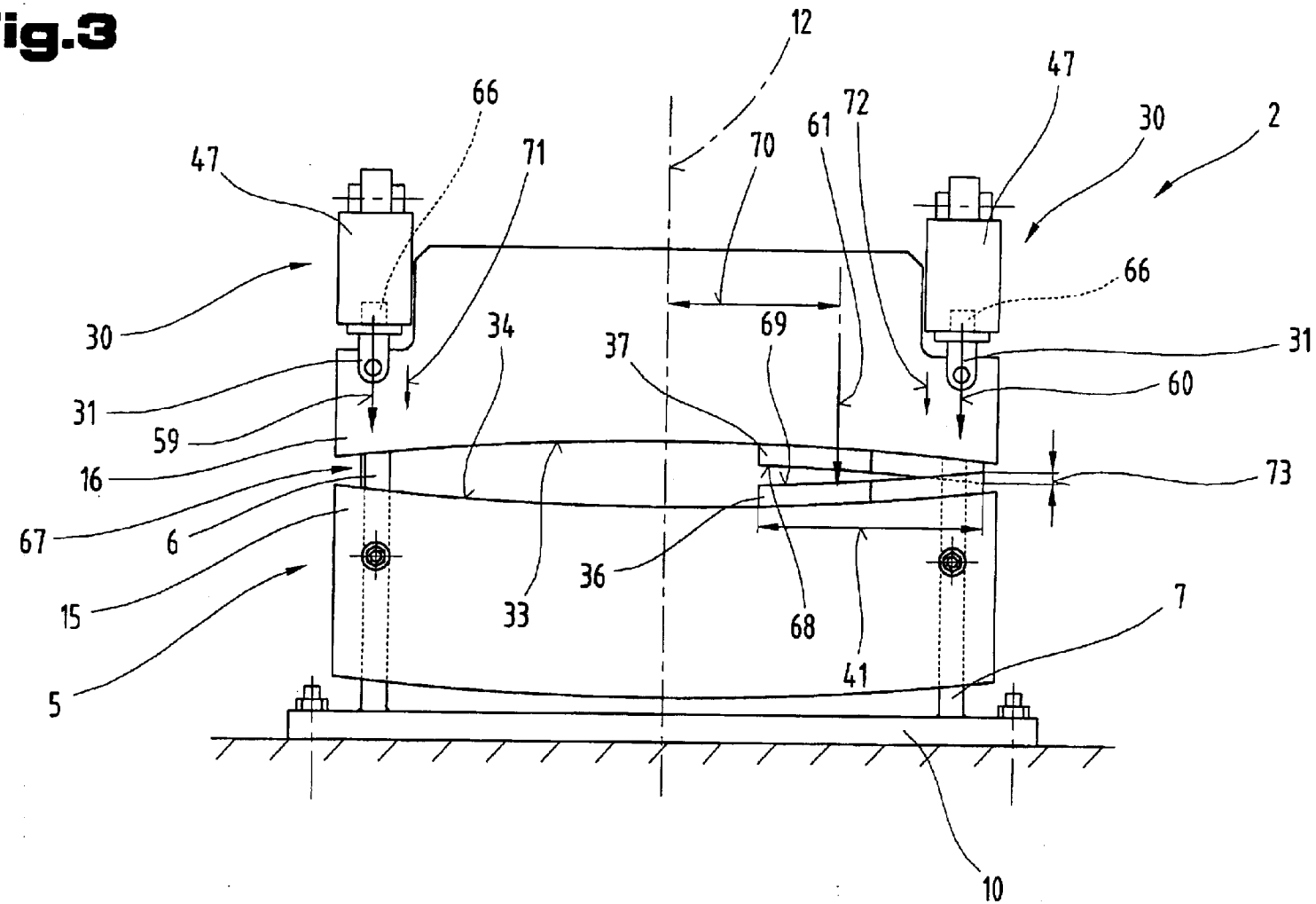
FIG. 3 is a schematic diagram illustrating the deformations which occur on a bending press.

FIG. 3 provides a schematic, very exaggerated illustration of the situation which arises due to pressure-dependent bending of the press beams 15, 16 when the bending tools 36, 37 are disposed on a bending press 2 in an off-center arrangement. In an arrangement of this type, depending on the bending force required—indicated by arrow 61—the compression forces to be applied by the drives 30—indicated by arrows 59, 60—will vary in magnitude according to the disposition of the moment. Firstly, this will produce a different type of flexing in the C-shaped stand sides 6, 7 to which the drives 30 are attached. Secondly, it will cause non-symmetrical bending in the press beams 15, 16, as indicated in a very exaggerated manner. Depending on the respective bending line which, other than the dimensions and material characteristic values of the press beams 15, 16, also depends on the bending force and position of the bending tools and tool length, the relative position of the bending tools 36, 37 changes and hence the position of the mutually facing working edges or work surfaces 68 69 of the bending tools 36, 37, so that they extend at an angle to one another. However, even the slightest variance from the parallel immediately results in an unsatisfactory production result.

In order to prevent this, the method proposed by the invention and the edging press 2 designed to implement this method are such that during a first process step, on the basis of the compression forces—indicated by arrows 59, 60—applied by the drives 30 and their actuating elements 31, the position, i.e. a distance 70, of the resultant bending force—indicated by arrow 61—from the mid-plane 12 is determined and its order of magnitude ascertained. In addition to the order of magnitude of the bending force to be applied and the position of the bending tools 36, 37 on the press beams 15, 16, the effective tool length or bending length 64 for the sheet metal part 3 to be shaped are decisive as regards the bending lines of the press beams 15, 16 that will occur on the end faces 33, 34.

As explained above, the method proposed by the invention and the device proposed by the invention firstly offer the possibility of storing these dependencies in the form of a load-deformation matrix in the data memory 56 of the control and switching system 55 (see FIG. 1) co-operating with the evaluation and/or computer unit and assigning each of the drives 30 a displacement path—indicated by arrows 71, 72—based on this data in order to compensate for the deformation that will determine the angular position of the work surfaces 68, 69 and in order to produce the same thrust depth 73 of the bending tools 36, 37 across the entire bending length.

Instead of storing a load-deformation data file in the data memory 56 (see FIG. 1), it would naturally also be possible to determine the implications of the load distribution and hence the inherent deformations such as flexing in the stand sides 6, 7 and bending in the press beams 15, 16 by computation if the requisite computing capacity is available, enabling angular positions of the bending tools 36, 37 to be compensated by assigning displacements paths—indicated by arrows 71, 72—accordingly.

Detection of the compression forces—indicated by arrows 59, 60—and the selection of appropriate detection means 51 (see FIG. 1) will naturally depend on the type of drives 30 selected, which, as mentioned above, might be hydraulic cylinders 47 but could also be electrically powered drives, linear drives, etc. Alternatively, the loads causing the deformation may also be detected by mounting strain gauges 67 on the stand sides 6, 7 and press beams 15, 16, for example.

For the sake of good order, it should finally be pointed out that in order to provide a clearer understanding of the production unit 1, it and its constituent parts have been illustrated out of scale to a certain extent and/or on an enlarged and/or reduced scale.

The tasks underlying the independent inventive solutions can be found in the description.

Above all, subject matter relating to the individual embodiments illustrated in FIGS. 1; 2; 3 can be construed as independent solutions proposed by the invention. The tasks and solutions can be found in the detailed descriptions relating to these drawings.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method of operating a bending press having a machine frame comprising two stand sides spaced at a distance apart from one another, and a stationary press beam and a displaceable press beam displaceable in guide arrangements and driven by a drive system incorporating at least two drives each acting on the displaceable press beam at a respective force-application point, and having tool clamping devices for holding pressing tools on mutually facing compression surfaces of the press beams, and having a control unit connected to the drive system and a measuring device for detecting machine data during production of workpieces, the method comprising the steps of:

detecting an actual pressing force exerted by each drive of the drive system on the displaceable press beam during a bending process for the workpiece;

determining a relative position of the pressing tool or tools with respect to a longitudinal direction of the press beams on the basis of the pressing forces of the drives;

determining a resultant bending force and a resultant bending line of the press beams;

using an evaluation unit having a data memory for production and machine data to determine a displacement path for each of the drives at the respective force-application point of each drive on the basis of a computed position of the resultant bending force, wherein deformation data of the bending press are stored in the data memory, and the displacement paths of each drive are determined based on the deformation data stored in the data memory; and generating control signals for the drive system in the control unit, so as to displace actuator elements of the drives by the displacement paths determined for each drive.

2. The method as claimed in claim 1, wherein load-dependent deformations of the bending press are computed from the pressing forces of the drives on the basis of algorithms stored in the evaluation unit, and the displacement paths of the drives and the actuator elements are determined so as to take into account the load-dependent deformations.

3. The method as claimed in claim 1, wherein the displacement path of each drive is determined in the evaluation unit on the basis of one or more of material data for the workpiece to be shaped, an effective tool length of the pressing tools, and a bending angle, which are stored in the data memory.

4. The method as claimed in claim 1, wherein the displacement path of each drive is determined in the evaluation unit on the basis of machine data of the bending press stored in the data memory, said machine data comprising load-dependent flexing behavior of the stand sides of the bending press.

5. The method as claimed in claim 1, wherein the displacement path of each drive is determined in the evaluation unit on the basis of machine data of the bending press stored in the data memory, said machine data comprising force-dependent bending behavior of the press beams.

6. The method as claimed in claim 1, wherein the displacement path of each drive is determined in the evaluation unit on the basis of algorithms stored in the data memory for the force-dependent flexing behavior of the stand sides.

7. The method as claimed in claim 1, wherein the displacement path of each drive is determined in the evaluation computer unit on the basis of algorithms stored in the data memory for the force-dependent bending behavior of the press beams.

8. The method as claimed in claim 1, wherein flexing and/or bending behavior of the stand sides and the press beams is determined so as to produce measurement data, and the control signals for the drive system are generated from said measurement data in the evaluation unit.

9. The method as claimed in claim 1, wherein the detected actual pressing forces are compared in a control circuit of the evaluation unit with desired pressing forces stored in the data memory, and the control signals for the drive system are forwarded to the control unit accordingly.

10. The method as claimed in claim 1, wherein actual displacement paths detected by a displacement-measuring system are compared in a control circuit of the evaluation unit with desired displacement paths stored in the data memory and control signals for the drive system are forwarded to the control unit accordingly.

11. A bending press, comprising a machine frame having two stand sides spaced at a distance apart from one another, and a stationary press beam and a displaceable press beam displaceable in guide arrangements by a drive system incorporating at least two drives each acting on the displaceable press beam at a respective force-application point, and having tool clamping devices for holding pressing tools on mutually facing compression surfaces of the press beams, and having a control unit connected by lines to the drive system and a measuring device for detecting machine data, wherein the control unit is an evaluation unit provided with a data memory and has a displacement control and regulating device for the drives and detection means for the machine data provided in the form of sensors for measuring at least one of force, pressure, energy, and strain, wherein the data memory stores deformation data of the bending press, and the control unit is structured and arranged to determine displacement paths of each drive based on the deformation data stored in the data memory, and to generate control signals for the drive system so as to displace actuator elements of the drives by the displacement paths determined for each drive.

12. The bending press as claimed in claim 11, wherein the detection means are disposed on the stand sides.

13. The bending press as claimed in claim 11, wherein the detection means are disposed on the press beams.

14. The bending press as claimed in claim 11, further comprising a displacement-measuring device for measuring displacement of the drives.

15. The bending press as claimed in claim 11, further comprising a displacement-measuring device provided between the machine frame and the displaceable press beam.

16. The bending press as claimed in claim 11, further comprising a displacement-measuring device disposed between the stationary press beam and the displaceable press beam.

17. The bending press as claimed in claim 11, wherein the displaceable press beam can be adjusted to a position parallel with the stationary press beam or to a position in which end faces of the press beams subtend an acute angle.

18. The bending press as claimed in claim 11, wherein the displacement control and regulating device is a freely programmable controller or a computer.

19. A method of operating a bending press having a machine frame comprising two stand sides spaced at a distance apart from one another, and a stationary press beam and a displaceable press beam displaceable in guide arrangements and driven by a drive system incorporating at least two drives each acting on the displaceable press beam at a respective force-application point, and having tool clamping devices for holding pressing tools on mutually facing compression surfaces of the press beams, and having a control unit connected to the drive system and a measuring device for detecting machine data during production of workpieces, the method comprising the steps of:

detecting an actual pressing force exerted by each drive of the drive system on the displaceable press beam during a bending process for the workpiece;

determining a relative position of the pressing tool or tools with respect to a longitudinal direction of the press beams on the basis of the pressing forces of the drives;

determining a resultant bending force and a resultant bending line of the press beams;

using an evaluation unit having a data memory for production and machine data to determine a displacement path for each of the drives at the respective force-application point of each drive on the basis of a computed position of the resultant bending force, wherein load-dependent deformations of the bending press are computed from the pressing forces of the drives, and the displacement paths of the drives are determined so as to take into account the load-dependent deformations; and generating control signals for the drive system in the control unit, so as to displace actuator elements of the drives by the displacement paths determined for each drive.

* * * * *

UNITED STATES PATENT AND TRADEMARK OFFICE

CERTIFICATE OF CORRECTION

PATENT NO. : 6,871,521 B2
DATED : March 29, 2005
INVENTOR(S) : Sperrer

It is certified that error appears in the above-identified patent and that said Letters Patent is hereby corrected as shown below:

Title page,
Item [73], Assignee, "Pasching (AU)" should read -- Pasching (AT) --.

Signed and Sealed this

Fifth Day of July, 2005

JON W. DUDAS
*Director of the United States Patent and Trademark Office*